US007870930B2

(12) United States Patent
Bogard

(10) Patent No.: US 7,870,930 B2
(45) Date of Patent: Jan. 18, 2011

(54) EXHAUST SYSTEM WITH EXTERNAL HELMHOLTZ RESONATOR AND ASSOCIATED METHOD

(75) Inventor: Joseph Trent Bogard, Seymour, IN (US)

(73) Assignee: EMCON Technologies LLC

( * ) Notice: Subject to any disclaimer, the term of this patent is extended or adjusted under 35 U.S.C. 154(b) by 970 days.

(21) Appl. No.: 11/219,150

(22) Filed: Sep. 2, 2005

(65) Prior Publication Data

US 2007/0051556 A1 Mar. 8, 2007

(51) Int. Cl.
*F01N 1/02* (2006.01)
*F01N 1/00* (2006.01)
*F01N 1/08* (2006.01)

(52) U.S. Cl. ..... 181/250; 181/266; 181/272; 181/273; 181/276

(58) Field of Classification Search ..... 181/249, 181/250, 251, 255, 266, 268, 272, 273, 275, 181/276, 269, 232, 265
See application file for complete search history.

(56) References Cited

U.S. PATENT DOCUMENTS

| | | | | | |
|---|---|---|---|---|---|
| 536,753 | A | * | 4/1895 | Loper | 181/273 |
| 2,065,232 | A | * | 12/1936 | Mackenzie et al. | 181/232 |
| 2,103,810 | A | * | 12/1937 | Caspar | 181/273 |
| 2,297,046 | A | * | 9/1942 | Bourne | 181/250 |
| 2,337,299 | A | * | 12/1943 | Noblitt et al. | 181/266 |
| 2,468,454 | A | * | 4/1949 | Mason | 181/248 |
| 2,618,354 | A | * | 11/1952 | Hedrick | 181/266 |
| 2,656,005 | A | * | 10/1953 | Cary | 181/266 |
| 2,661,073 | A | * | 12/1953 | Deremer | 181/273 |
| 3,087,579 | A | * | 4/1963 | Katogir | 181/271 |
| 3,107,748 | A | * | 10/1963 | Arthur et al. | 181/245 |
| 3,340,957 | A | * | 9/1967 | Vautaw et al. | 181/268 |
| 3,389,764 | A | | 6/1968 | Kelson | |
| 3,402,785 | A | * | 9/1968 | Heath et al. | 181/250 |
| 3,434,565 | A | * | 3/1969 | Fischer | 181/250 |
| 3,447,629 | A | * | 6/1969 | Placek | 181/266 |
| 3,519,098 | A | * | 7/1970 | Plaga, Jr. | 181/269 |
| 3,543,878 | A | | 12/1970 | Hamilton | |
| 3,583,524 | A | * | 6/1971 | Dubois | 181/266 |
| 3,655,011 | A | * | 4/1972 | Willett | 181/228 |
| 4,094,644 | A | | 6/1978 | Wagner | |
| 4,109,755 | A | * | 8/1978 | Grueneberg | 181/256 |
| 4,111,279 | A | | 9/1978 | Sterrett | |
| 4,124,092 | A | | 11/1978 | Kajiya et al. | |

(Continued)

FOREIGN PATENT DOCUMENTS

JP 59041618 A * 3/1984

(Continued)

OTHER PUBLICATIONS

Drawing of Exhaust Assembly (1 page) (Feb. 2004).

*Primary Examiner*—Edgardo San Martin
(74) *Attorney, Agent, or Firm*—Pamela A. Kachur

(57) ABSTRACT

An exhaust system comprises a muffler and a Helmholtz resonator. The muffler comprises an exhaust inlet aperture for receiving exhaust gas into the muffler, an exhaust outlet aperture for discharging exhaust gas from the muffler, and a resonator aperture. The Helmholtz resonator is at least partially external to the muffler and in acoustic communication with the resonator aperture. An associated method is disclosed.

27 Claims, 1 Drawing Sheet

U.S. PATENT DOCUMENTS 4,381,832 A * 5/1983 Rauch ..... 181/266
4,416,350 A * 11/1983 Hayashi ..... 181/272
4,501,341 A * 2/1985 Jones ..... 181/250
4,693,339 A 9/1987 Beale et al.
4,786,299 A 11/1988 DeMarco
4,846,302 A * 7/1989 Hetherington ..... 181/243
5,246,356 A 9/1993 Scarfone
5,349,141 A * 9/1994 Horibe et al. ..... 181/224
5,493,080 A * 2/1996 Moss ..... 181/232
5,602,368 A 2/1997 Kaneso
5,723,828 A * 3/1998 Nakagawa ..... 181/250
5,726,397 A * 3/1998 Mukai et al. ..... 181/232
5,821,474 A 10/1998 Olszok et al.
5,839,405 A 11/1998 Falkowski et al.
6,082,487 A 7/2000 Angelo et al.
6,158,214 A 12/2000 Kempka et al.
6,349,541 B1 2/2002 Gruden et al.
6,354,398 B1 3/2002 Angelo et al.
6,558,137 B2 5/2003 Tomell et al.
6,702,190 B1 3/2004 Nohl et al.
6,732,509 B2 5/2004 Shiga
6,732,510 B2 5/2004 Ciray
6,755,279 B2 * 6/2004 Kaneko et al. ..... 181/232
6,799,657 B2 10/2004 Daniels
6,889,499 B2 5/2005 Bassani
7,240,769 B2 * 7/2007 Nezan et al. ..... 181/250
7,246,680 B2 * 7/2007 Osterkamp et al. ..... 181/250
2003/0066288 A1 4/2003 Shiga
2003/0145584 A1 8/2003 Ciray
2003/0145585 A1 8/2003 Uhler et al.
2004/0065504 A1 4/2004 Daniels
2004/0069563 A1 4/2004 Zirkelbach
2004/0118632 A1 6/2004 Ciray
2004/0223854 A1 11/2004 Tomell et al.
2004/0238272 A1 12/2004 Wan et al.
2005/0011698 A1 1/2005 Bassani

FOREIGN PATENT DOCUMENTS

JP 03067012 A * 3/1991

* cited by examiner

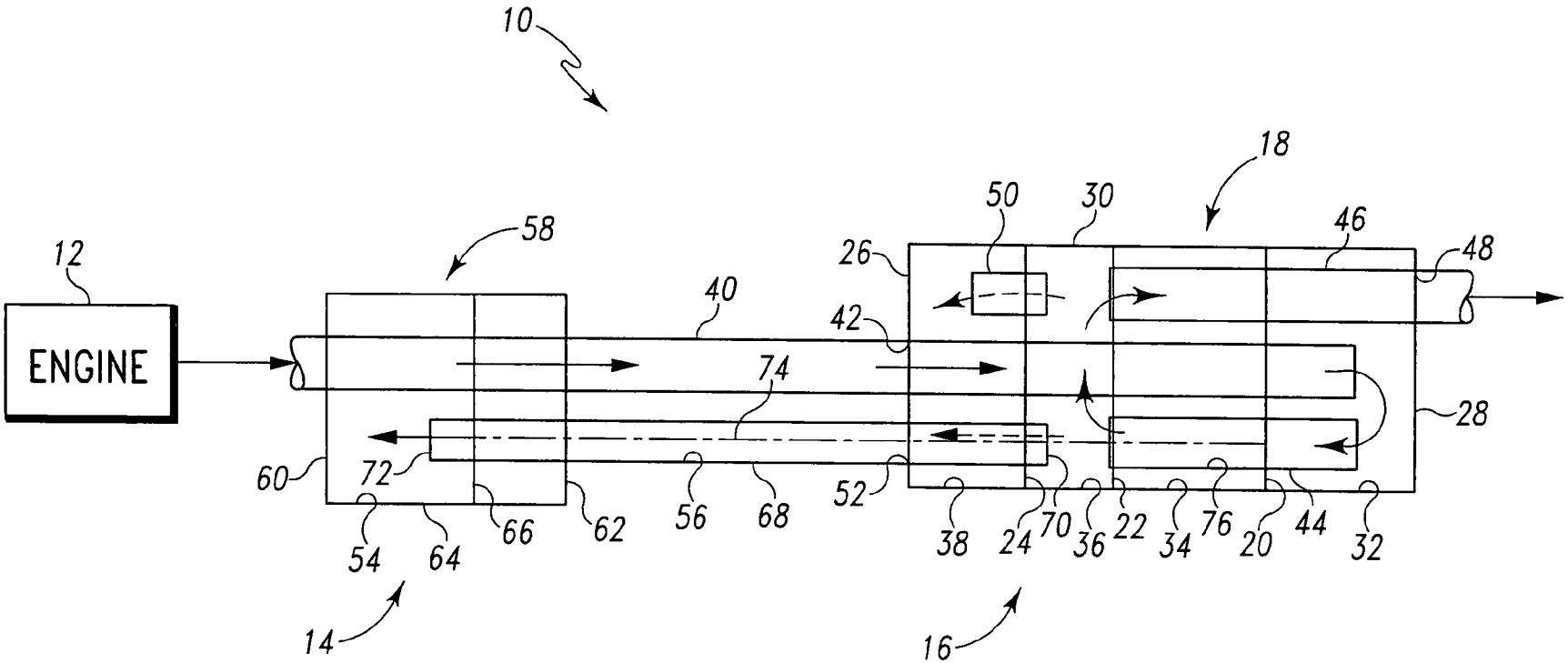
Figure

EXHAUST SYSTEM WITH EXTERNAL HELMHOLTZ RESONATOR AND ASSOCIATED METHOD

FIELD OF THE DISCLOSURE

The present disclosure relates to methods and apparatus for abatement of sound in engine exhaust gas.

BACKGROUND OF THE DISCLOSURE

Typical internal combustion engines generate noise at a variety of frequencies over its operating range. Engine exhaust systems often have components to eliminate or otherwise reduce this noise.

SUMMARY OF THE DISCLOSURE

According to an aspect of the present disclosure, there is provided an exhaust system that comprises a muffler and a Helmholtz resonator. The muffler may be used for attenuation of a number of acoustic frequencies whereas the Helmholtz resonator may be used for attenuation of a particular predetermined acoustic frequency. The muffler comprises an exhaust inlet aperture for receiving exhaust gas into the muffler, an exhaust outlet aperture for discharging exhaust gas from the muffler, and a resonator aperture. The Helmholtz resonator is at least partially external to the muffler and in acoustic communication with the resonator aperture. An associated method is disclosed.

Illustratively, the Helmholtz resonator comprises a Helmholtz chamber external to the muffler and a tuning throat connecting the resonator aperture and the Helmholtz chamber. The Helmholtz chamber and tuning throat are configured to "select" the predetermined acoustic frequency for attenuation.

The above and other features of the present disclosure will become apparent from the following description and the attached drawings.

BRIEF DESCRIPTION OF THE DRAWINGS

The FIGURE is a diagrammatic view showing an exhaust system of an engine.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the disclosure to the particular forms disclosed, but on the contrary, the intention is to cover all modifications, equivalents, and alternatives following within the spirit and scope of the invention as defined by the appended claims.

Referring to the FIGURE, there is shown an exhaust system 10 of an internal combustion engine 12. The exhaust system 10 has a muffler 16 and a Helmholtz resonator 14. The muffler 16 is used to attenuate a plurality of acoustic frequencies present in the exhaust gas of the engine 12 whereas the resonator 14 is provided for attenuating a single predetermined acoustic frequency which may be, for example, a low-level frequency (e.g., 50 Hz).

The muffler 16 may take a variety of forms. One example is illustrated in the FIGURE. In the illustrated example, the muffler 16 has a muffler housing 18 and first, second, and third baffles 20, 22, 24 inside the housing 18. First and second end walls 26, 28 of the housing 18 are secured to opposite ends of a shell 30 of the housing 18. The baffles 20, 22, 24 are secured to the shell 30 and are spaced apart from one another and the end walls 26, 28 to define first, second, third, and fourth chambers 32, 34, 36, 38 inside the housing 18. The first chamber 32 is defined between the second end wall 28 and the first baffle 20. The second chamber 34 is defined between the first and second baffles 20, 22. The third chamber 36 is defined between the second and third baffles 22, 24. The fourth chamber 38 is defined between the third baffle 24 and the first end wall 26.

An inlet pipe 40 introduces exhaust gas of the engine 12 into the muffler 16. The inlet pipe 40 is secured to and extends through an exhaust inlet aperture 42 defined in the first end wall 26 and is secured to and extends through apertures defined in the baffles 20, 22, 24. As such, the inlet pipe 40 extends to the first chamber 32 where it introduces exhaust gas into the first chamber 32. The first chamber 32 thus acts as an exhaust inlet chamber for receiving exhaust gas from the inlet pipe 40.

Exhaust gas then turns 180° in the first chamber 32 to flow through a transition pipe 44 which conducts exhaust gas from the first chamber 32 to the third chamber 36. To do so, the transition pipe 44 extends from the first chamber 32 to the third chamber 36 and extends through and is secured to apertures defined in the first and second baffles 20, 22.

Exhaust gas next turns another 180° in the third chamber to flow through a muffler outlet pipe 46 which conducts exhaust gas from the third chamber 36 through an exhaust outlet aperture 48 defined in the second end wall 28 for discharge from the muffler 16. The muffler outlet pipe 46 extends through and is secured to apertures defined in the first and second baffles 20, 22 and extends through and is secured to the aperture 48.

As exhaust gas follows the thus-described tortuous path from the exhaust inlet aperture 42 through the muffler 16 to the exhaust outlet aperture, acoustic frequencies present in the exhaust gas are attenuated. Any one or more of the inlet pipe 40, the transition pipe 44, and the outlet pipe 46 may include means (e.g., perforation field, louvers) for allowing acoustic communication with the second chamber 34 to further promote acoustic attenuation in the muffler 16. The fourth chamber 38 acts as a Helmholtz chamber internal to the muffler 16 for attenuation of sound communicated thereto through a stub pipe 50 extending through and secured to an aperture defined in the third baffle 24.

The Helmholtz resonator 14 is configured for attenuating a predetermined acoustic frequency such as a relatively low frequency or other frequency. The Helmholtz resonator 14 is at least partially external to the muffler 16 and is in acoustic communication with a resonator aperture 52 defined in the first end wall 26. This external feature of the resonator 14 enables the resonator 14 to provide the extra length needed for attenuation of a relatively low frequency while alleviating packaging concerns that would be associated with a muffler 16 enlarged to incorporate the resonator 14 inside the muffler 16.

The resonator 14 has a Helmholtz chamber 54 and a tuning throat 56. The Helmholtz chamber 54 is external to the muffler 16. The tuning throat 56 connects the resonator aperture 52 of the muffler 16 and the Helmholtz chamber 54 for acoustic communication between the muffler 16 and the Helmholtz chamber 54. The dimensions of the chamber 54 and the tuning throat 56 may be selected for attenuation of the acoustic frequency of interest according to the following equation:

$$f = \frac{c}{2\pi}\sqrt{\frac{S}{VL}}$$

where, f is the acoustic frequency to be attenuated, c is the speed of sound in the exhaust gas, S is the cross-sectional area of the tuning throat 56, V is the volume of the Helmholtz chamber 54, and L is the length of the tuning throat 56.

The Helmholtz chamber 54 is defined in a housing 58 of the resonator 14. The resonator housing 58 has first and second end walls 60, 62 secured to opposite ends of a shell 64. The Helmholtz chamber 54 is defined between the first end wall 60 and a baffle 66 positioned in the housing 58 and secured to the shell 64.

The tuning throat 56 extends from the third chamber 36 of the muffler 16 through the resonator aperture 52 to the Helmholtz chamber 54 for acoustic communication therebetween. The tuning throat 56 has a throat inlet aperture 70 in the chamber 36 of the muffler 16 and a throat outlet aperture 72 in the chamber 54 of the resonator 14 for such acoustic communication.

The tuning throat 56 is defined in a pipe 68 of the resonator 14. As such, the resonator pipe 68 extends through and is secured to the resonator aperture 52 and apertures defined in the baffles 24, 66 and the end wall 62.

The resonator pipe 68 is aligned with the transition pipe 44 so as to be coaxial therewith and axially spaced apart therefrom relative to an axis 74. As such, the tuning throat 56 and an exhaust passageway 76 defined in the transition pipe 44 are coaxial with one another relative to the axis 74. Such coaxial alignment promotes suitable "charging" of the resonator 14 for attenuation of the predetermined acoustic frequency thereby.

The resonator housing 64 is secured to the muffler inlet pipe 40. As such, the resonator housing 64 is secured to both the muffler inlet pipe 40 and the resonator pipe 68, thereby promoting the overall structural integrity of the exhaust system 10. Exemplarily, the muffler inlet pipe 40 extends through and is secured to apertures defined in the first and second end walls 60, 62 and the baffle 66.

It is to be understood that the term "pipe" as used herein means one or more tubes such that, in the case of at least two tubes, the tubes are connected together in series.

The exhaust system 10 is configured for use with a variety of engines 12 including those configured for cylinder deactivation and those not configured for cylinder deactivation. In the case where the engine 10 is configured for cylinder deactivation, the engine 10 is under the control of a control system for operation in at least two modes. The number of engine cylinders operating in the first mode is less than the number of engine cylinders operating in the second mode. The resonator 14 may be used to attenuate an acoustic frequency in each mode or in only one of the modes. The frequencies attenuated in the engine modes may be the same or different.

Exemplarily, the first mode may be a 4-cylinder mode and the second mode may be an 8-cylinder mode. In such a case, the resonator 14 is particularly useful for attenuating low frequencies at low engine speeds in the 4-cylinder and 8-cylinder modes while the volume of the Helmholtz chamber 54 is positioned in a "packageable" location.

In addition to the resonator 14 and muffler 16, the exhaust system 10 may include other sound abatement devices. For example, there may be additional Helmholtz resonators or mufflers in the system 10. The system 10 may be a dual exhaust system and the resonator 14, muffler 16, and possibly other sound abatement devices may be in each leg of the dual exhaust system.

While the concepts of the present disclosure have been illustrated and described in detail in the drawings and foregoing description, such illustration and description is to be considered as exemplary and not restrictive in character, it being understood that only illustrative embodiments have been shown and described and that all changes and modifications that come within the spirit of the disclosure are desired to be protected.

There are a plurality of advantages of the concepts of the present disclosure arising from the various features of the systems described herein. It will be noted that alternative embodiments of each of the systems of the present disclosure may not include all of the features described yet still benefit from at least some of the advantages of such features. Those of ordinary skill in the art may readily devise their own implementations of a system that incorporate one or more of the features of the present disclosure and fall within the spirit and scope of the invention as defined by the appended claims.

The invention claimed is:

1. A method, comprising the steps of:

receiving an inlet pipe within an exhaust inlet aperture of a muffler, advancing exhaust gas of an engine from the exhaust inlet aperture through the muffler to an exhaust outlet aperture of the muffler, and attenuating a predetermined acoustic frequency of exhaust gas advanced through the muffler with a Helmholtz resonator connected to the inlet pipe and which is at least partially external to the muffler and in acoustic communication with a resonator aperture of the muffler.

2. The method of claim 1, wherein:

the Helmholtz resonator comprises (i) a Helmholtz chamber external to the muffler and (ii) a tuning throat connecting the Helmholtz chamber and the resonator aperture, and the attenuating step comprises attenuating the predetermined acoustic frequency by use of the Helmholtz chamber and the tuning throat.

3. The method of claim 2, wherein the advancing step comprises advancing exhaust gas through an exhaust passageway that is coaxial with the tuning throat.

4. The method of claim 1, further comprising operating the engine in a first mode and a second mode, wherein:

the number of engine cylinders operating in the first mode is less than the number of engine cylinders operating in the second mode, and the attenuating step comprises attenuating one or more acoustic frequencies with the Helmholtz resonator during operation of the engine in the first and second modes.

5. An exhaust system, comprising:

a muffler comprising an exhaust inlet aperture for receiving exhaust gas into the muffler, an exhaust outlet aperture for discharging exhaust gas from the muffler, and a resonator aperture, an inlet pipe received within the exhaust inlet aperture, and a Helmholtz resonator at least partially external to the muffler and in acoustic communication with the resonator aperture wherein the Helmholtz resonator is connected with the inlet pipe.

6. The exhaust system of claim 5, wherein the Helmholtz resonator comprises a Helmholtz chamber external to the muffler.

7. The exhaust system of claim 6, wherein the Helmholtz resonator comprises a tuning throat connecting the resonator aperture and the Helmholtz chamber.

8. The exhaust system of claim 5, wherein the Helmholtz resonator comprises a tuning throat extending from the resonator aperture to a location external to the muffler.

9. The exhaust system of claim 5, wherein:

the muffler comprises first and second chambers and an exhaust passageway to conduct exhaust gas from the first chamber to the second chamber, the tuning throat comprises an inlet aperture associated with the second chamber, and the tuning throat and the exhaust passageway are coaxial.

10. The exhaust system of claim 5, wherein the muffler comprises a housing defining the exhaust inlet aperture, the exhaust outlet aperture, and the resonator aperture.

11. The exhaust system of claim 5, in combination with an engine operable in a first mode and a second mode, wherein:

the number of engine cylinders operating in the first mode is less than the number of engine cylinders operating in the second mode, and the Helmholtz resonator is configured to attenuate a predetermined acoustic frequency associated with operation of the engine in the first mode or the second mode.

12. An exhaust system, comprising:

a muffler comprising a muffler housing defining an exhaust inlet aperture for receiving exhaust gas into the muffler, an exhaust outlet aperture for discharging exhaust gas from the muffler, and a resonator aperture, a muffler inlet pipe, a Helmholtz resonator for attenuating a predetermined acoustic frequency, the Helmholtz resonator comprising a resonator housing and a resonator pipe, the resonator housing external to the muffler housing, the muffler inlet pipe connecting the resonator housing and the exhaust inlet aperture, the resonator pipe connecting the resonator aperture and the resonator housing for acoustic communication between the resonator aperture and a Helmholtz chamber defined in the resonator housing via a tuning throat defined in the resonator pipe.

13. The exhaust system of claim 12, wherein:

the resonator housing comprises first and second end walls, the Helmholtz resonator comprises a baffle positioned inside the resonator housing between the first and second end walls, the resonator pipe is secured to the first end wall and the baffle, and the Helmholtz chamber is defined between the baffle and the second end wall.

14. The exhaust processor of claim 13, wherein the muffler inlet pipe is secured to the first and second end walls and the baffle.

15. The exhaust processor of claim 12, wherein:

the muffler housing comprises an end wall defining the exhaust inlet aperture and the resonator aperture, and the muffler inlet pipe is secured to the end wall at the exhaust inlet aperture, and the resonator pipe is secured to the end wall at the resonator aperture.

16. The exhaust processor of claim 12, wherein:

the muffler comprises a first chamber, a second chamber, and a transition pipe extending from the first chamber to the second chamber, the resonator pipe comprises an inlet aperture associated with the second chamber, and the resonator pipe and the transition pipe are spaced axially apart from one another along an axis and coaxial relative to the axis.

17. The exhaust processor of claim 12, wherein:

the muffler housing comprises first and second end walls and a shell extending from the first wall to the second wall, the first end wall defines the exhaust inlet aperture and the resonator aperture, the second end wall defines the exhaust outlet aperture, the muffler comprises first, second, and third baffles secured to the shell and positioned in the muffler housing between the first and second end walls, the first baffle is positioned between the second end wall and the second baffle to define a first chamber between the first baffle and the second end wall, the second baffle is positioned between the first baffle and the third baffle to define a second chamber between the first baffle and the second baffle and a third chamber between the second baffle and the third baffle, the third baffle is positioned between the second baffle and the first end wall to define a fourth chamber between the third baffle and the first end wall, the muffler inlet pipe extends from the exhaust inlet aperture defined in the first end wall through the first, second, and third baffles to the first chamber, the muffler comprises a transition pipe extending from the first chamber through the first and second baffles to the third chamber, the resonator pipe extends from the third chamber through the thud baffle and the resonator aperture defined in the first end wall, and the resonator pipe and the transition pipe are coaxial.

18. The method of claim 1, further comprising attenuating a second predetermined acoustic frequency of the exhaust gas advanced through the muffler with a Helmholtz chamber that is internal to the muffler.

19. The exhaust system of claim 5, wherein the muffler further comprises an internal Helmholtz chamber.

20. The exhaust system of claim 12, wherein the muffler further comprises a Helmholtz chamber internal to the muffler housing.

21. The method of claim 1, wherein the Helmholtz resonator comprises a resonator housing that is external to the muffler and including connecting the inlet pipe to the resonator housing and the exhaust inlet aperture, and connecting a tuning throat of the Helmholtz resonator to the resonator housing and the resonator aperture.

22. The method of claim 1, wherein the muffler includes an outlet pipe received within the exhaust outlet aperture, and including advancing exhaust gas through a transition pipe that conducts exhaust gas exiting from the inlet pipe to the outlet pipe, and wherein the Helmholtz resonator includes a resonator housing external to the muffler and a resonator pipe with a tuning throat that extends from the resonator housing and into the muffler, and including aligning the resonator pipe to be coaxial with the transition pipe.

23. The exhaust system of claim 5, wherein the Helmholtz resonator comprises a resonator housing that is external to the muffler and wherein the inlet pipe is connected to the resonator housing and the exhaust inlet aperture.

24. The exhaust system of claim 23, wherein the Helmholtz resonator includes a resonator pipe with a tuning throat that is received within the resonator aperture, and wherein the inlet pipe extends through the resonator housing, and wherein the resonator pipe has one end extending into the resonator housing and an opposite end extending into the muffler.

25. The exhaust system of claim 5, wherein the muffler includes an outlet pipe received within the exhaust outlet aperture and a transition pipe that conducts exhaust gas exiting from the inlet pipe to the outlet pipe, and wherein the inlet pipe, outlet pipe and transition pipe are non-coaxial, and wherein the Helmholtz resonator includes a resonator housing that is external to the muffler and a resonator pipe with a tuning throat that extends from the resonator housing and into the muffler wherein the resonator pipe is aligned to be coaxial with the transition pipe.

26. The exhaust system of claim 12, wherein the muffler inlet pipe is received within the exhaust inlet aperture, and the resonator pipe comprises a tuning throat, and wherein the muffler inlet pipe extends entirely through the resonator housing and wherein the resonator pipe has one end extending into an internal cavity of the resonator housing and an opposite end extending into an internal cavity of the muffler.

27. The exhaust system of claim 12, wherein the muffler inlet pipe is received within the exhaust inlet aperture, and including an outlet pipe received within the exhaust outlet aperture and a transition pipe that conducts exhaust gas exiting from the muffler inlet pipe to the outlet pipe, wherein the muffler inlet pipe, outlet pipe and transition pipe are non-coaxial, and wherein the resonator pipe extends from the resonator housing and into the muffler with the resonator pipe being aligned to be coaxial with the transition pipe.

* * * * *